US007650945B2

(12) United States Patent
Brown

(10) Patent No.: US 7,650,945 B2
(45) Date of Patent: Jan. 26, 2010

(54) INFLATABLE CLOSURE SYSTEM

(75) Inventor: Barry Lee Brown, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 111 days.

(21) Appl. No.: 11/598,483

(22) Filed: Nov. 13, 2006

(65) Prior Publication Data

US 2008/0110634 A1 May 15, 2008

(51) Int. Cl.
*E21B 34/06* (2006.01)
*E21B 33/12* (2006.01)

(52) U.S. Cl. ..... 166/373; 166/187; 166/116; 166/192

(58) Field of Classification Search ..... 166/373, 166/386, 387, 192, 277, 332, 334, 187, 116
See application file for complete search history.

(56) References Cited

U.S. PATENT DOCUMENTS

| | | | | |
|---|---|---|---|---|
| 2001/0054505 | A1 * | 12/2001 | Carmody et al. | 166/250.15 |
| 2002/0056553 | A1 * | 5/2002 | Duhon et al. | 166/302 |
| 2002/0092654 | A1 * | 7/2002 | Coronado et al. | 166/369 |
| 2004/0055758 | A1 * | 3/2004 | Brezinski et al. | 166/384 |
| 2004/0069494 | A1 * | 4/2004 | Olsen et al. | 166/357 |
| 2005/0189119 | A1 * | 9/2005 | Gynz-Rekowski | 166/387 |
| 2006/0042801 | A1 * | 3/2006 | Hackworth et al. | 166/387 |
| 2006/0266530 | A1 * | 11/2006 | Echols | 166/387 |

* cited by examiner

*Primary Examiner*—Jennifer H Gay
*Assistant Examiner*—Yong-Suk Ro
(74) *Attorney, Agent, or Firm*—Shawn Hunter

(57) ABSTRACT

A closure device that is useful as a safety valve within a tubular member, such as production tubing and pipelines. The closure device includes an inflatable bladder that is disposed within a cavity in the wall of the tubular member. A fluid conduit interconnects a fluid source with the inflatable bladder, and a pump is associated with the fluid conduit to flow fluid between the fluid source and the bladder.

16 Claims, 3 Drawing Sheets

INFLATABLE CLOSURE SYSTEM

BACKGROUND OF THE INVENTION

1. Field of the Invention

The invention relates generally to the design of safety valves for use in closing off portions of a well during an emergency.

2. Description of the Related Art

Safety valves are used to close off portions of a live well in the event of an emergency, such as a blow out. Well-based safety valves are typically of two conventional styles: flapper valve and ball-style valve. Flapper valves have a substantially-disc-shaped flapper member that is pivotably secured to the surrounding string of tubing. The flapper valve is spring-biased toward a closed position, but during normal operation, is held in an open position by an axially moveable flow tube. When it is desired to close the flapper valve, the flow tube is moved axially within the tubing string so that it no longer holds the flapper valve in an open position. The spring then urges the flapper member to the closed position wherein it blocks fluid flow through the flowbore. The flapper valve can be reopened by axially moving the flow tube to urge the flapper member back into the open position. The ability to rapidly close a flapper valve has made it a popular choice as a safety valve in production string arrangements.

Ball valves have a generally spherical closure member that can be rotated within a housing to permit or completely block fluid flow across the housing. The ability to completely close off flow through a flowbore has made ball valves popular as a safety valve in pipelines, and to some extent in production tubing strings.

Unfortunately flapper and ball-type valve assemblies are substantially formed of mechanical, largely metallic, components that are inherently prone to risk of failure over time due to corrosion or mechanical breakdown. The environs of a wellbore or pipeline are extremely hostile to such devices due to the presence of extreme temperatures and pressures and corrosive and caustic chemicals.

The present invention addresses the problems of the prior art.

SUMMARY OF THE INVENTION

The invention provides a closure device that is useful as a safety valve within a tubular member, such as production tubing and pipelines. In a currently preferred embodiment, the closure device includes an inflatable bladder that is disposed within a cavity in the wall of the tubular member. A fluid conduit interconnects a fluid source with the inflatable bladder, and a pump is associated with the fluid conduit to flow fluid between the fluid source and the bladder. Preferably, a frangible wall or barrier is integrated into the tubular member to retain the bladder element within the cavity while in the uninflated condition and protect it from damage by fluids or tools passing through the tubular member during normal operation.

In operation, the closure device is actuated from a non-inflated condition, wherein the bladder element is not inflated and resides within the cavity, to an inflated condition, wherein the bladder element is inflated to completely block the flowbore of the tubular member. If present, the frangible barrier is ruptured by the inflatable bladder element. The closure device is actuated to the inflated condition by operating the pump to flow fluid from the fluid source into the interior of the bladder element. As the bladder element fills with fluid, it will block off the flowbore of the tubular member. When it is desired to unblock the flowbore, the pump is operated to flow fluid from the bladder element to the fluid source, thereby collapsing the bladder element and permitting it to retract again into the cavity.

The closure device is useful generally for plugging the flowbore of a tubular member, particularly in a rapid and temporary manner. As a result, the closure device of the present invention is particularly useful as a safety valve within a production tubing string or a pipeline either as a replacement for or back up to a conventional flapper or ball-style safety valve. The construction of the closure device of the present invention makes it virtually impervious to corrosion or mechanical failure. The closure device is simple and inexpensive as well.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
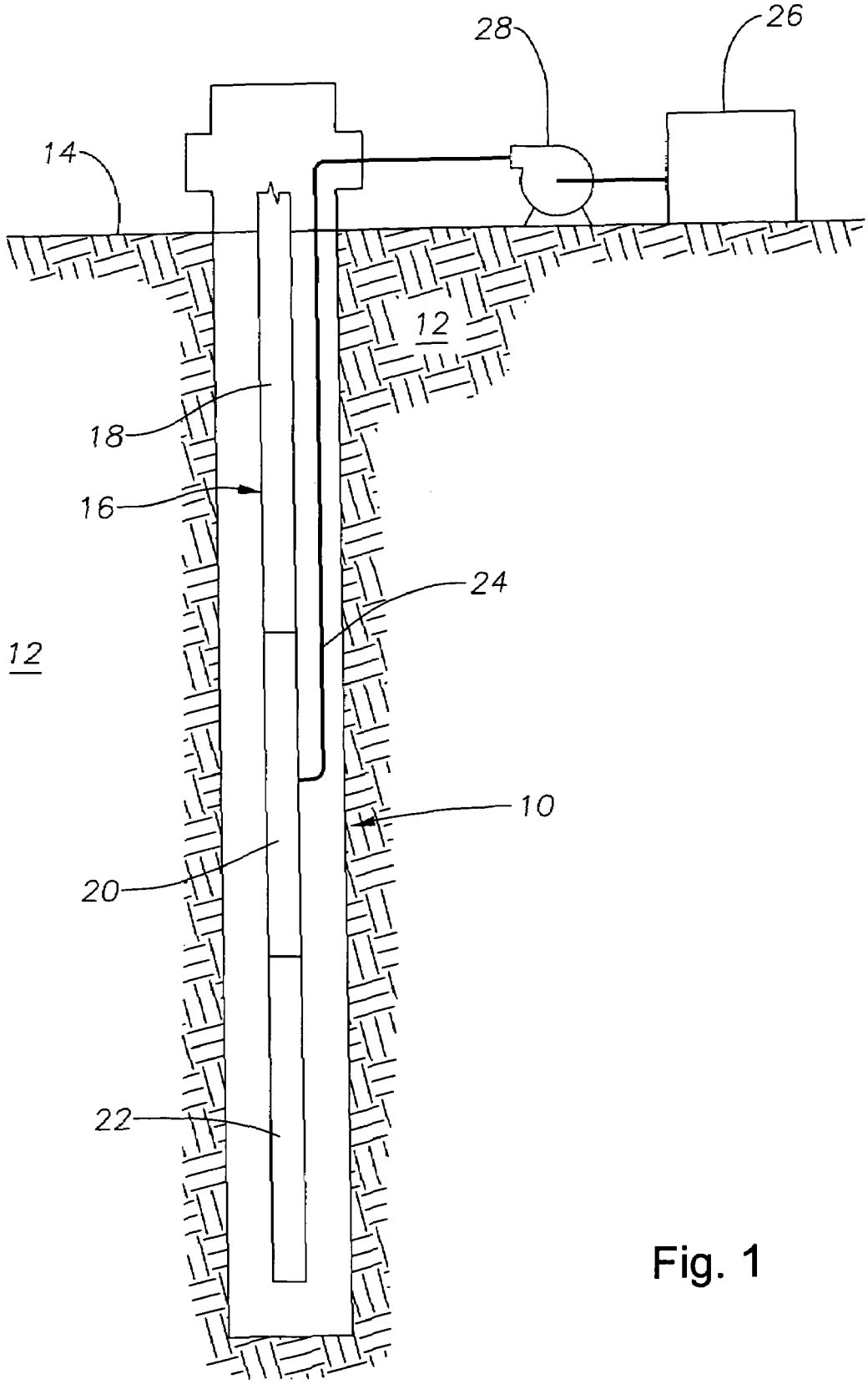
FIG. 1 is a schematic view of an exemplary wellbore containing production tubing having an exemplary closure device constructed in accordance with the present invention.

FIG. 1 depicts an exemplary production wellbore 10 that has been drilled through the earth 12 from the surface 14. The wellbore 10 contains a string 16 of production tubing. As the details of hydrocarbon production string construction and their use in production of hydrocarbons is well known, they will not be discussed in detail herein. The production tubing string 16 is made up of a plurality of tubing sections 18, 20, 22, which are interconnected in an end-to-end fashion, as is known in the art. Tubing section 20 contains a closure device in accordance with the present invention, the details of which will be described in conjunction with FIGS. 2 and 3. A fluid conduit 24 extends between the tubing section 20 and a fluid source 26 located at the surface 14. The fluid conduit 24 is preferably tubing that is affixed to the outer radial surface of the production string 16. However, the fluid conduit 24 may instead be a flow path 24*a* (see FIGS. 2 and 3) that is axially drilled through the side wall 34 of the tubing section 20. A fluid pump 28 is also associated with the fluid conduit 24 to selectively flow fluid from the fluid source 26 to the tubing section 20 and from the tubing section 20 to the fluid source 26.

Figure 3:
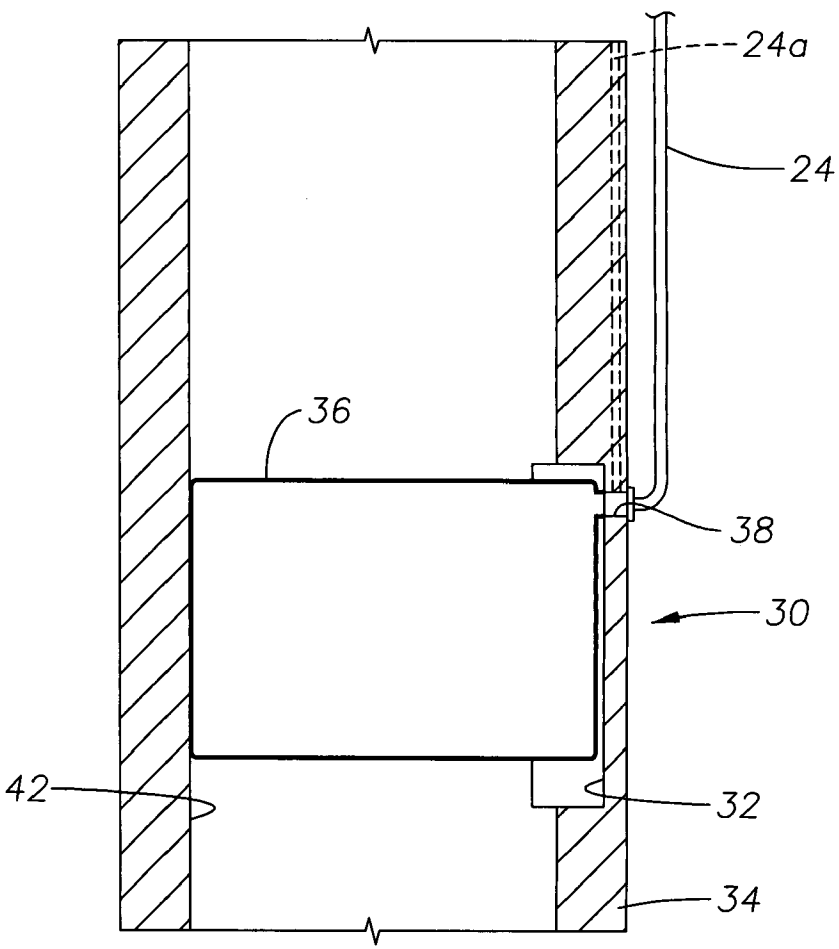
FIG. 3 is a side, cross-sectional view of the production tubing section shown in FIG. 2, now with the closure device in an inflated condition.
Figure 2:
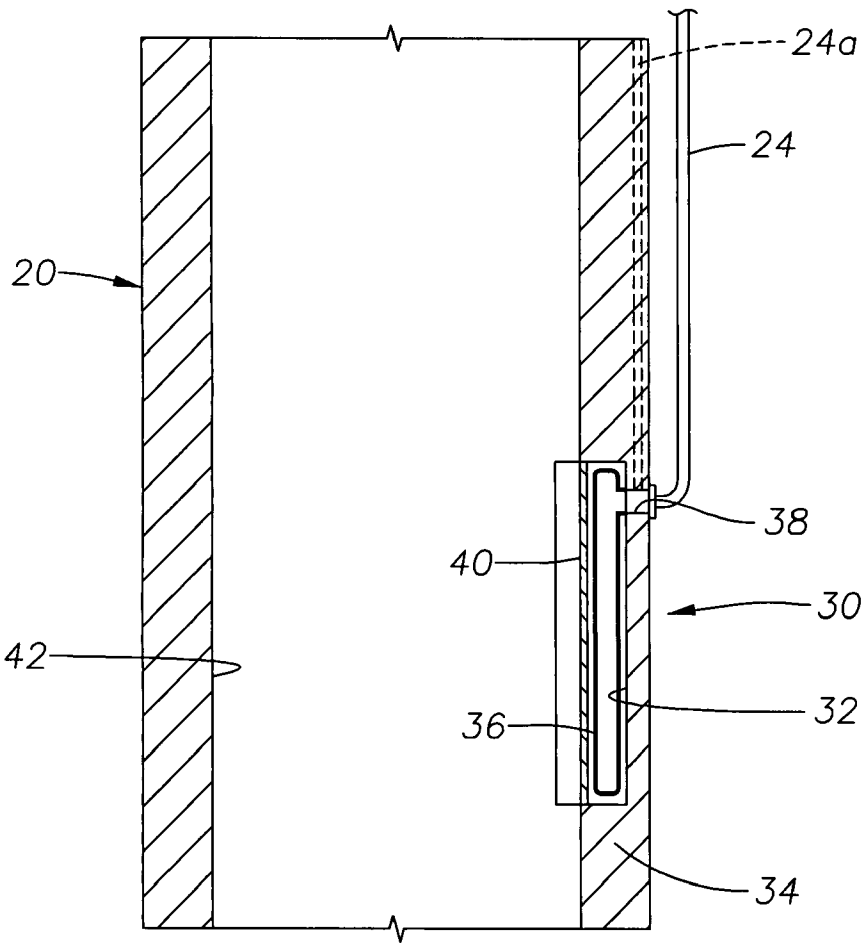
FIG. 2 is a side, cross-sectional view of the section of production tubing containing the closure device and with the closure device in a non-inflated condition.

Referring now to FIGS. 2 and 3, the closure device 30 is illustrated. A cavity 32 is cut or milled into the side wall 34 of the tubing section 20. An inflatable bladder element 36 is disposed within the cavity 32 and interconnected with fluid conduit 24 at port 38. The bladder element 36 is preferably fashioned from elastomeric material which will allow the bladder element 36 to expand and stretch as fluid is flowed into the bladder element 36. However, the bladder element 36 may also be formed of another suitable fluid impermeable material, such as laminated textiles or fabrics, sheet-form polymers and so forth. It is currently preferred that the bladder element 36 have a shape that is generally cylindrical to approximate the shape of the interior flowbore of the production string 16. However, other suitable forms and shapes may be used for the bladder, including, for example, a generally spherical shape.

Figure 5:
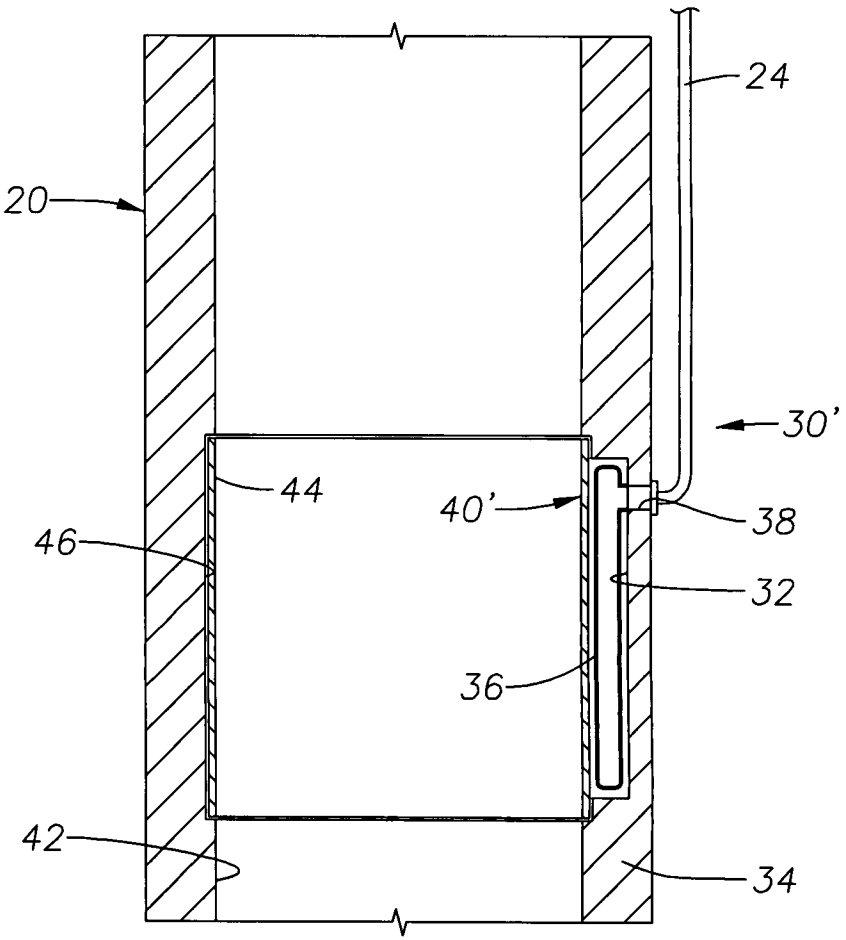
FIG. 5 is a side, cross-sectional view of a production tubing section having a closure device with an alternative-style of frangible barrier.
Figure 4:
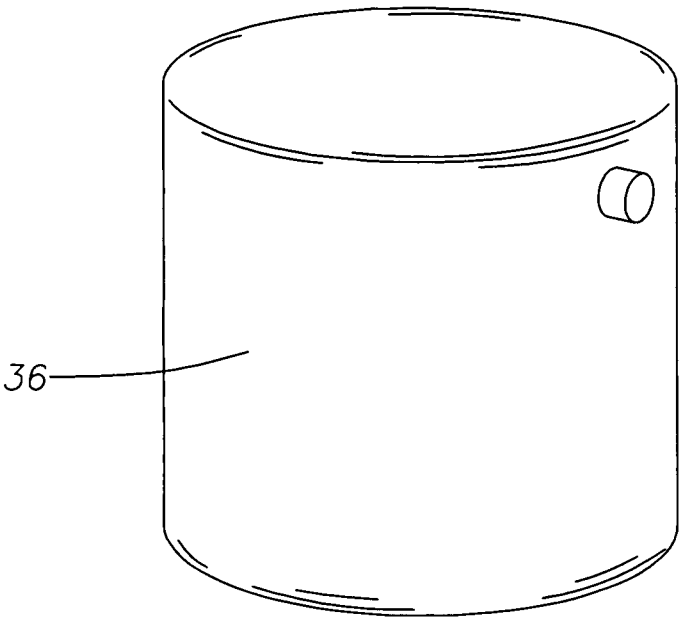
FIG. 4 is an isometric view of the bladder element apart from other components of the closure device.

Preferably, the bladder element 36 is retained within the cavity 32 while in the uninflated condition by a frangible wall or barrier 40. The barrier 40 is preferably formed of plastic or thin, relatively brittle metal that can be shattered or broken away by inflation of the bladder element 36. The barrier 40 should have a curved planar shape to approximate the curvature of the inner surface of the flowbore 42. FIG. 5 illustrates an alternative closure device 30' wherein the frangible barrier 40' is formed by a frangible annular ring 44 which resides within enlarged annular recess 46 within the flowbore 42.

The closure device 30 is initially in the configuration depicted in FIG. 2, with the bladder element 36 collapsed and being disposed within the cavity 32. As a result, tools and fluids may be passed through the flowbore 42 of the production string 16 during typical operation. When it is desired to actuate the closure device 30, the pump 28 flows fluid from the fluid source 26 through the fluid conduit 24 (or 24*a*) and into the bladder element 36. As the bladder element 36 is filled with fluid, it expands to block off the flowbore 40. Because the cross-sectional area of the flowbore 42 is not great, only a small amount of fluid actually needs to be pumped into the bladder element 36 to effect total closure of the flowbore 40. As a result, the closure device 30 can rapidly and effectively close off fluid flow through the flowbore 42. This makes the closure device 30 effective for use as a safety valve within a production tubing string, such as string 16, or within a pipeline or other tubular member used to flow or transport fluids.

When it desired to reopen the flowbore 42 of the tubing string 16 to flow, this is accomplished by reversing the flow of the pump 28 to flow fluid from the bladder element 36 back toward the fluid source 26. The bladder element 36 is collapsed to be retained once again in the cavity 32 of the tubing section 20. Flow is then reestablished through the tubing string 16.

It is noted that the closure device of the present invention has numerous uses and applications, including use of the closure device as a safety valve for a hydrocarbon pipeline, water pipeline, or other fluid transport flowline. It is also noted that the term "tube," as used herein with respect to the phrases "tubular member," "tubing" and so forth, is not restricted to flow spaces with a cylindrical shape (i.e., with a generally circular axial cross-section), but is instead intended to encompass enclosed flow spaces of any other desired cross-sectional shape, such as rectangular, oval, annular, non-symmetrical, etc. In addition, the term "tube" also contemplates enclosed flow spaces whose cross-sectional shape or size varies along the length of the tube.

Those of skill in the art will recognize that numerous modifications and changes may be made to the exemplary designs and embodiments described herein and that the invention is limited only by the claims that follow and any equivalents thereof.

What is claimed is:

1. A closure device for use in blocking fluid flow through a flowbore of a tubular member, the flowbore having a curved planar inner surface, the closure device comprising:

an inflatable bladder element disposed within a cavity formed within the flowbore of the tubular member, the bladder element having a non-inflated condition, wherein the flowbore is not blocked, and an inflated condition, wherein the flowbore is blocked; and a frangible barrier within the tubular member to retain the bladder element within the cavity while in the uninflated condition, the frangible barrier having a curved planar shape that exacts the curvature of the inner surface of the flowbore.

2. The closure device of claim 1 wherein the inflatable bladder element is substantially comprised of an elastomeric material.

3. The closure device of claim 1 wherein the inflatable bladder element is substantially comprised of a fluid impermeable material.

4. The closure device of claim 1 further comprising a fluid conduit associated with a surface-based fluid source and the inflatable bladder element for selectively inflating the bladder element with fluid from the fluid source.

5. The closure device of claim 4 further comprising a pump operably associated with the fluid conduit to selectively flow fluid between the fluid source and the bladder element.

6. The closure device of claim 4 wherein the fluid conduit comprises tubing affixed to a radial exterior surface of the tubular member.

7. The closure device of claim 1 wherein the tubular member comprises a production tubing string.

8. The closure device of claim 1 wherein the tubular member comprises a hydrocarbon pipeline.

9. The closure device of claim 1 wherein the bladder element is cylindrically shaped.

10. The closure device of claim 1 wherein the frangible barrier further comprises a frangible ring.

11. A closure device for use in blocking fluid flow through a flowbore of a tubular member, the closure device comprising:

an inflatable bladder element disposed within a cavity formed within the flowbore of the tubular member, the bladder element having a non-inflated condition, wherein the flowbore is not blocked, and an inflated condition, wherein the flowbore is blocked;

a surface-based fluid source to supply fluid to the bladder element for inflation;

a fluid conduit interconnecting the fluid source to the bladder element to transmit fluid between the fluid source and the bladder element; and a frangible barrier within the tubular member to retain the bladder element within the cavity while in the uninflated condition, the frangible barrier having a curved planar shape that exacts the curvature of the inner surface of the flowbore.

12. The closure device of claim 11 further comprising a fluid pump associated with the fluid conduit to flow fluid between the fluid source and the bladder element.

13. The closure device of claim 11 wherein the bladder element is cylindrically shaped.

14. A method of selectively blocking fluid flow within a tubular member having a flowbore that presents a curved inner surface, the method comprising the steps of:

flowing fluid from a surface-based fluid source to an inflatable bladder element that is retained within a cavity formed in the flowbore by a frangible barrier, the frangible barrier having a curved planar shape that exacts the curvature of the inner surface of the flowbore;

inflating the bladder element from an uninflated condition to an inflated condition to block fluid flow through the flowbore; and rupturing the frangible barrier as the bladder element is inflated.

15. The method of claim 14 wherein the step of flowing fluid from the fluid source to the bladder element comprises operating a fluid pump.

16. The method of claim 14 further comprising the step of restoring flow through the flowbore by flowing fluid from the bladder element to the fluid source to return the bladder element to its uninflated condition.

* * * * *